US005568656A

United States Patent [19]

Kim

[11] Patent Number: 5,568,656

[45] Date of Patent: Oct. 29, 1996

[54] METHOD AND APPARATUS FOR AN IMPROVED WATERPROOF GLOVE LINER

[76] Inventor: Joo-In Kim, 250-3 Nonhyun-Dong, (Hyundai Billa B-5) Kangnam-ku, Seoul, Rep. of Korea

[21] Appl. No.: 413,250

[22] Filed: Mar. 30, 1995

[30] Foreign Application Priority Data

Jul. 14, 1994 [KR] Rep. of Korea ..... 1994-17015

[51] Int. Cl.[6] ..... A41D 19/00

[52] U.S. Cl. ..... 2/164; 2/167; 2/169

[58] Field of Search ..... 2/159, 161.1, 164, 2/167, 161.6, 169, 163

[56] References Cited

U.S. PATENT DOCUMENTS

| | | | |
|---|---|---|---|
| 3,151,334 | 10/1964 | Haupt et al. | 2/169 |
| 3,251,067 | 5/1966 | Shmilder | 2/169 |
| 3,869,726 | 3/1975 | Bell . | |
| 4,430,759 | 2/1984 | Jackrel . | |
| 4,545,841 | 10/1985 | Jackrel . | |
| 4,662,006 | 5/1987 | Ross, Jr. . | |
| 4,679,257 | 7/1987 | Town . | |
| 4,733,413 | 3/1988 | Dykstra . | |
| 4,741,052 | 5/1988 | Rubin . | |
| 4,847,918 | 7/1989 | Sturm . | |
| 5,123,119 | 6/1992 | Dube . | |
| 5,167,038 | 12/1992 | Rinehart . | |
| 5,442,818 | 8/1995 | Loos | 2/169 |

*Primary Examiner*—C. D. Crowder
*Assistant Examiner*—Larry O. Worrell, Jr.
*Attorney, Agent, or Firm*—Limbach & Limbach L.L.P.; Ronald L. Yin; Alan A. Limbach

[57] ABSTRACT

A method and apparatus for an improved waterproof glove is disclosed. A waterproof membrane and a cloth lining are laminated together to make a glove lining material. Then, front and back hand portions shaped as the front and back of a hand are cut out of the glove lining material. An opening is provided in the front portion for the thumb. A thumb portion is cut out of the glove lining material. An adhesive is silk screened onto the edges of the front and/or back hand portions. The edges of the front hand portion are then high frequency welded to the edges of the back hand portion to form the glove liner. The thumb portion is sewn onto the front hand portion and waterproof sealing tape is applied over the stitches to maintain the waterproof integrity of the glove liner. The glove liner is inserted into an outer glove shell for durability.

21 Claims, 5 Drawing Sheets

METHOD AND APPARATUS FOR AN IMPROVED WATERPROOF GLOVE LINER

FIELD OF THE INVENTION

The present invention relates to waterproof glove liners, and in particular to a method and apparatus for a glove liner that utilizes a combination of cloth material and a waterproof membrane material that together are thin, durable, and waterproof.

BACKGROUND OF THE INVENTION

Currently, many types of gloves are made to be waterproof so rain or snow will not penetrate the glove to the hand while allowing water vapor (perspiration) to permeate out of the glove. These gloves are used for sports like skiing, snowboarding, motorcycle riding etc.

The most common method of manufacturing such a glove is to insert a glove-shaped cloth liner 2 into a glove-shaped waterproof membrane 4 (such as those membranes sold under the tradenames, GORETEX or AQUATEX etc.), and insert the membrane 4 into an outer glove-shaped shell 6, as illustrated in FIGS. 1*a* and 1*b*. The cloth glove liner 2 is for comfort and warmth and can include insulation. The outer shell 6 protects the membrane 4 and cloth liner 2 from wear and tear, and also provides a strong grip.

The difficulty of this method, however, is that the cloth liner 2, the waterproof membrane 4, and the shell 6 must be manufactured separately, and then carefully glued together to maintain the waterproof seal.

Gloves manufactured for activities in cold weather use a heavy, thick inner cloth liner filled with insulation. The thicker lining of these gloves makes it easier to provide a durable waterproof product because the thick lining helps protect the waterproof membrane from wear and tear.

Gloves manufactured for activities in warmer weather use little or no insulation. In fact, it is desired that the glove be very thin, lightweight, durable, and waterproof. In such a glove, there is no insulation to protect the waterproof membrane from the stresses of use, including putting on or pulling off the glove from the hand.

There is a need for a strong, thin, durable, comfortable, waterproof glove liner that is resistant to the wearing and tearing of the waterproof membrane without using a thick cloth liner.

Sewing methods cannot effectively be utilized to completely solve the aforementioned problems because water will leak through the needle holes. Sealing tape has been used over sewing seams to maintain the waterproof qualities of gloves that are sewn together. The problem with sealing tape is that it is practically unworkable around the finger extensions due to the narrow widths of those extensions. Therefore, there is a need for a liner that minimizes the use of sewing seams and sealing tape, especially on the finger extensions.

Some gloves are made by having the thumb portion extend out on the same plane as the finger extensions. This reduces the amount of sewing or other attaching means necessary when making the glove liner because the liner can be made from just two flat pieces of material attached together. The problem with not extending the thumb portion outside the plane of the finger extensions is that such a liner does not line up well with the outer shell and is therefore not as comfortable. There is a need to provide for a thumb extension outside the plane of the finger extensions that is still waterproof and durable.

Relevant references that involve gloves, glove liners, and waterproof glove liners are: U.S. Pat. No. 3,869,726; U.S. Pat. No. 4,430,759; U.S. Pat. No. 4,545,841; U.S. Pat. No. 4,662,006; U.S. Pat. No. 4,679,257; U.S. Pat. No. 4,733,413; U.S. Pat. No. 4,741,052; U.S. Pat. No. 4,847,918; U.S. Pat. No. 5,123,119; and U.S. Pat. No. 5,167,038.

SUMMARY OF THE INVENTION

The present invention solves the aforementioned problems by utilizing a new means for supporting the waterproof membrane, applying adhesive to component parts, welding the seams together, and attaching a thumb extension to the glove insert.

A waterproof membrane 22 and a cloth lining 24 are laminated together to make a glove lining material 20, as illustrated in FIG. 2*b*. Then, front and back hand portions shaped as the front and back of a hand are cut out of the glove lining material. An opening is provided in the front portion for the thumb. A thumb portion is cut out of the glove lining material. An adhesive is silk screened onto the edges of the front and/or back hand portions. The edges of the front hand portion are then high frequency welded to the edges of the back hand portion to form the glove liner.

The thumb portion is sewn onto the front hand portion and waterproof sealing tape is applied over the stitches to maintain the waterproof integrity of the glove liner. The glove liner is inserted into an outer glove shell for durability.

BRIEF DESCRIPTION OF THE DRAWINGS

FIG. 3 is a top view of the glove liner with the thumb sewn on.

FIG. 6*d* is a top view of the glove liner of the alternate embodiment with the two piece thumb portion sewn on.

DETAILED DESCRIPTION OF THE PREFERRED EMBODIMENTS

Figure 1A:
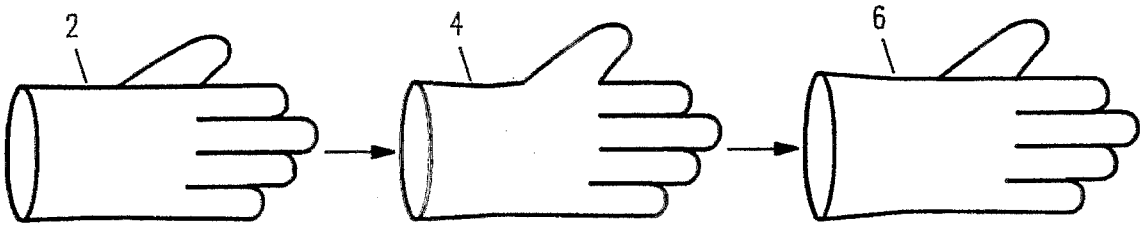
PRIOR ART FIG. 1a
FIG. 1*a* is a top view of the prior art method of inserting a cloth liner into a waterproof membrane, which is inserted into an outer protective shell.
Figure 1B:
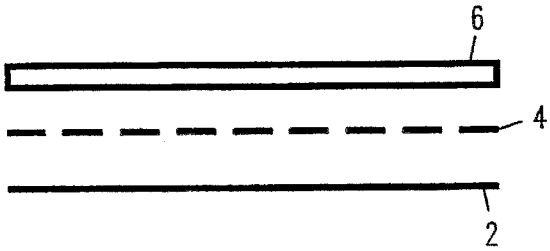
PRIOR ART FIG. 1b
FIG. 1*b* is a partial side drawing of the three layers used in the prior art.

The present invention is a method and apparatus for an improved waterproof glove liner. The waterproof glove liner is designated in its entirety as 10 and illustrated in FIG. 3. The glove liner 10 is made of a glove liner material 20, which is used to make the 3 component parts of the glove liner 10: a gloveback portion 30, a palm portion 40, and a thumb portion 50.

Figure 2A:
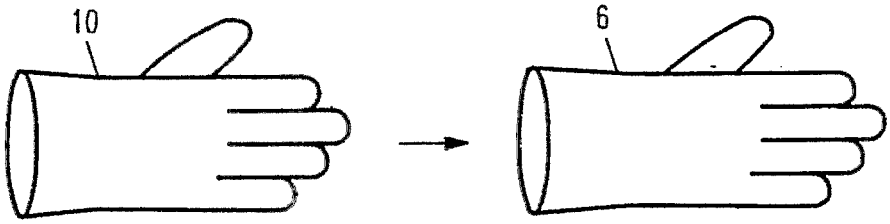
FIG. 2*a* is a top view of the present inventive method of inserting a glove liner comprising a cloth lining and a waterproof membrane into the protective shell.
Figure 2B:
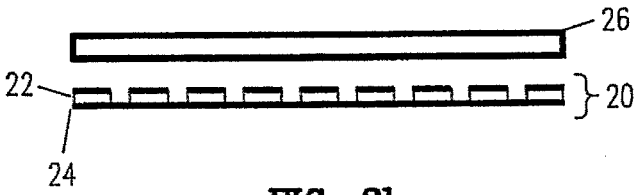
FIG. 2*b* is a partial side drawing of the present inventive glove liner containing cloth and a waterproof membrane, and the outer shell material.

The glove liner material 20 consists of a waterproof membrane 22 and a cloth liner 24 as illustrated in FIG. 2*b*. The cloth liner can be made of any material that is comfortable against the skin, especially cotton based cloth or brushed nylon. The waterproof membrane 22 is any material that passes water vapor, but does not allow water in liquid form to permeate the membrane 22. Such material is sold under the trade names GORETEX or AQUATEX.

The cloth liner material 24 is laminated to the waterproof membrane material 22 before either is cut to shape. The process of lamination is well known in the art. Lamination is preferable to other adhesive (or no adhesive) means because lamination avoids use of a film of adhesive between the membrane 22 and the cloth liner 24 that could impede the ability of the liner 10 to breath (water vapor out). Lamination to the cloth lining 24 also provides continuous support for the thin membrane 22 so as to avoid ripping or tearing of the membrane 22 during manufacture or during use.

Figure 4A:
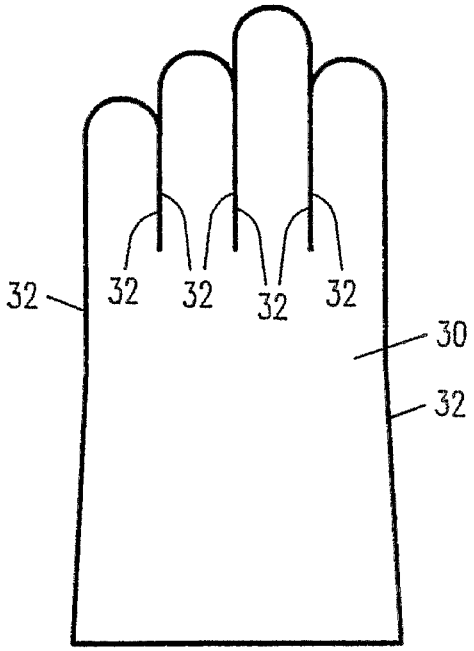
FIG. 4*a* is a top view of the glove back portion of the glove liner.
Figure 4B:
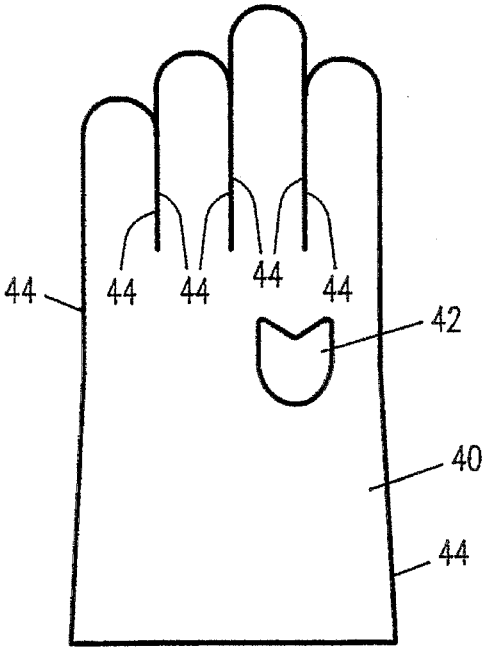
FIG. 4*b* is a top view of the palm portion of the glove liner.
Figure 4C:
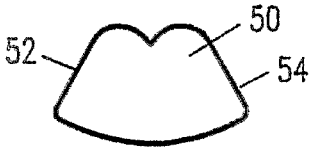
FIG. 4*c* is a top view of the thumb portion of the glove liner before it is folded over and attached to the palm portion.

The glove liner material 20 is cut into three separate shapes: a hand-shaped gloveback portion 30, a hand-shaped palm portion 40, and a thumb-shaped portion 50, as illustrated in FIGS. 4*a–c*. FIGS. 4*a–c* show a gloveback 30 with the cloth side up and a palm portion 40 with the waterproof membrane side up. The palm portion 40 as illustrated will be set on top of gloveback 30 as shown to make a right handed glove with the cloth liner 24 facing the inside the liner 10, and the membrane 22 facing the outside the liner 10. A left hand glove is made in a similar fashion with the dimensions shown reversed.

The gloveback 30 is flat and shaped as the back of a hand. The palm portion 40 is flat and shaped as the front of a hand (virtually the same as the gloveback). The palm portion 40 has a thumbhole 42 for a thumb to comfortably protrude therefrom. The thumb portion 50 is flat and is shaped as a thumb once folded around to where edges 52 and 54 meet.

Figure 5A:
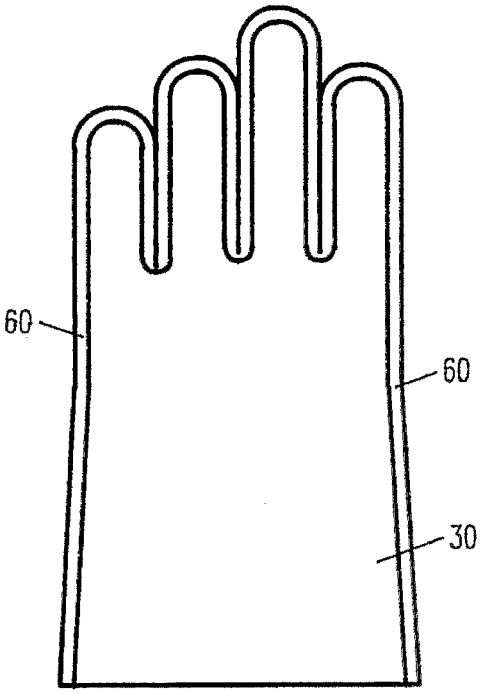
FIG. 5*a* is a top view of the gloveback portion of the glove liner with the silk-screened applied adhesive strip on its edges.
Figure 5B:
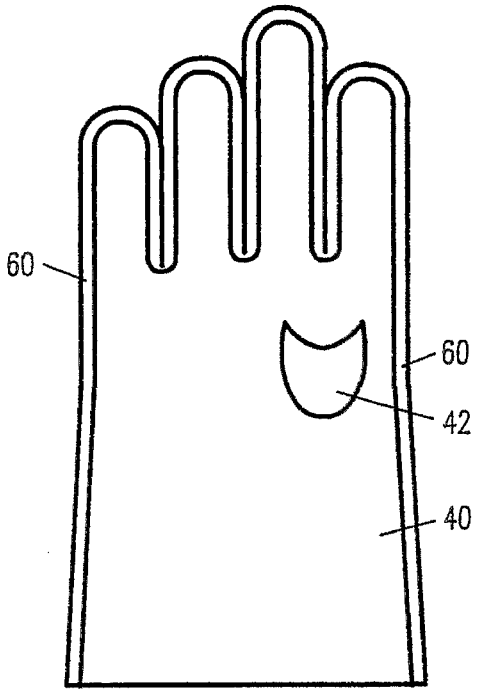
FIG. 5*b* is a top view of the palm portion of the glove liner with the silk-screened applied adhesive strip on its edges.

Gloveback 30 and palm portion 40 have welding edges 32 and 44 respectfully. Adhesive strip 60, which is the same shape as the outline of the gloveback 30 and the palm portion 40 is applied to at least one of the welding edges 32 or 44 using a silkscreen technique, as illustrated in FIGS. 5*a–b*. Liquid adhesive is silkscreened onto welding edges 32 and/or 44 to form adhesive strip 60. Silkscreening is advantageous because it is a quick and accurate technique for placing the liquid adhesive onto the welding edges 32 or 44.

Figure 5C:
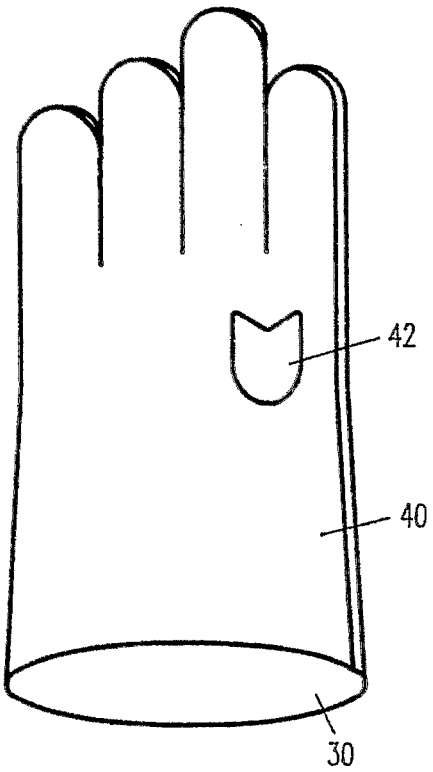
FIG. 5*c* is a top view of the gloveback and palm portions of the glove liner after they are welded together.

The palm portion 40 is then set on top of the gloveback 30 so welding edges 32 and 44 are separated only by the adhesive strip 60. The welding edges 32 and 44 are then welded together using a high frequency welding technique. The resulting embodiment is a glove liner having a cloth liner 24 facing inside, a waterproof membrane 22 facing outside, and a thumbhole 42, as illustrated by FIG. 5*c*.

High frequency welding is a well known technique which involves subjecting the adhesive strip 60 to microwave energy. The microwave energy heats the adhesive such that when the adhesive cools, there is a waterproof bond between the two welding edges 32 and 44.

Figure 3:
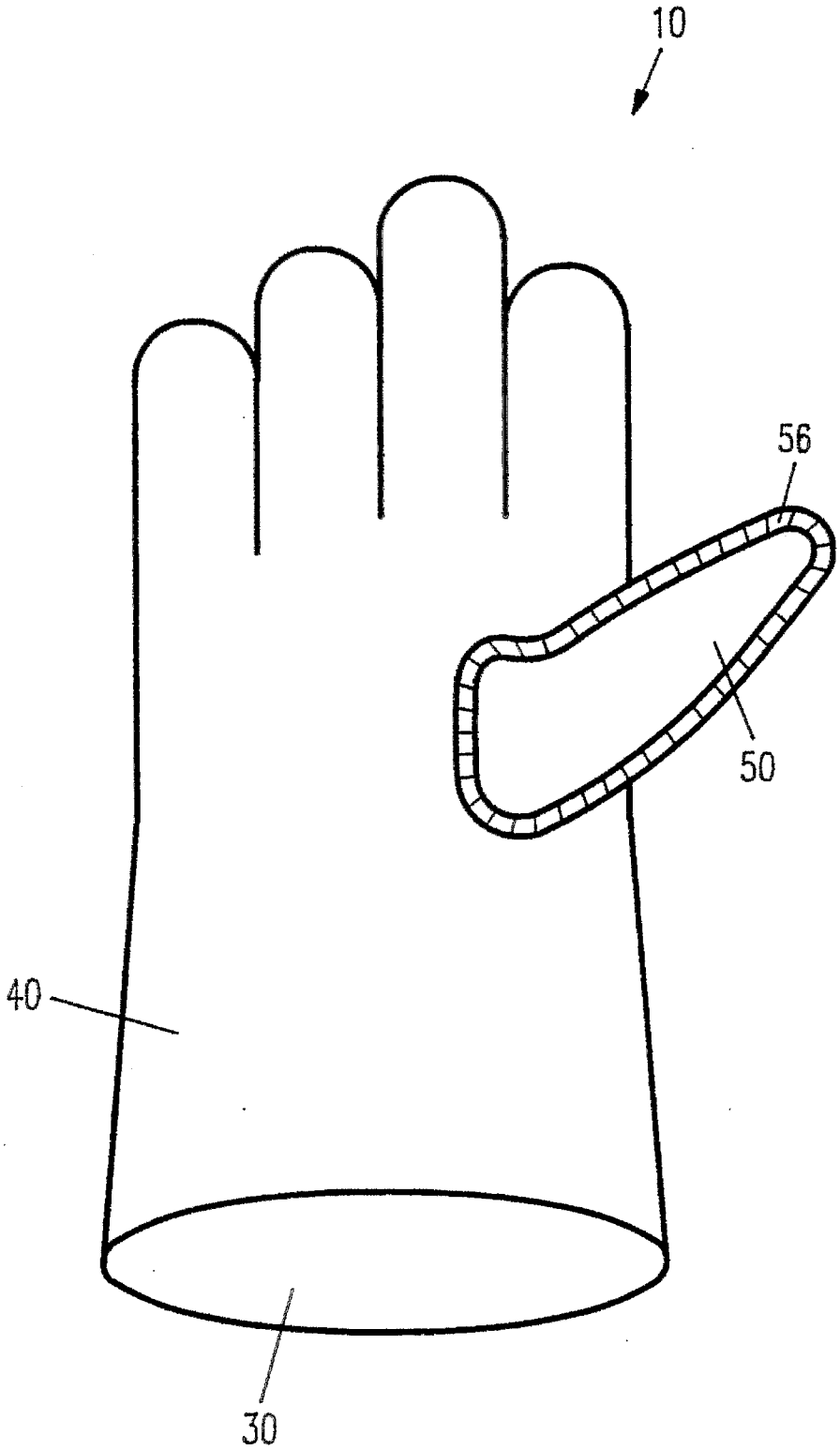

Thumb portion 50 is folded around where edges 52 and 54 are sewn together as well as the thumb portion 50 being sewn onto palm portion 40 with stitching 56. This provides a thumb extension outside the plane of the finger portion, as illustrated in FIG. 3.

The stitching 56 is covered with sealing tape (not shown) to ensure the stitching will not leak water. Sealing tape is not feasible for use on the finger extensions. Tape applying machines that apply tape to flat surfaces are well known. While these machines can be modified to apply tape to curved surfaces, these machines cannot be easily modified to accurately apply tape to small curved surfaces, such as those around the finger extensions of a glove. Tape applying machines are workable around the thumb portion stitching 56 because of the large and accessible area around the thumb portion. Further, this easy to access area allows for thicker sealing tape to be used for a better seal. The difficulty in applying tape around the finger extensions is the primary reason why the silkscreen high frequency welding method of the present invention is so advantageous over the prior art.

Figure 6A:
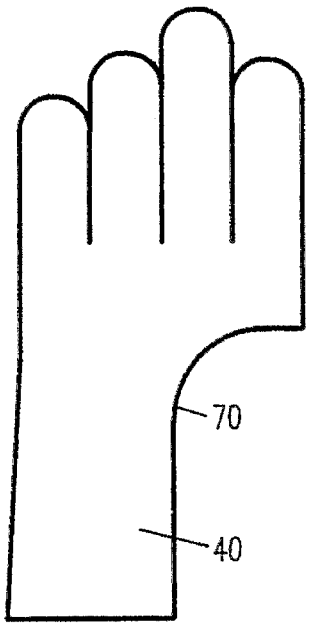
FIG. 6*a* is a top view of the gloveback portion in an alternate embodiment of the glove liner using a cut-out instead of a thumbhole.
Figure 6B:
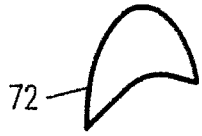
FIGS. 6*b–c* is a top view of the two piece thumb piece of the alternate embodiment of the glove liner.
Figure 6C:
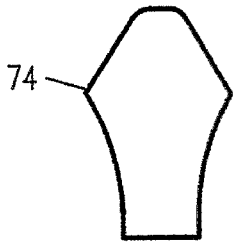
Figure 6D:
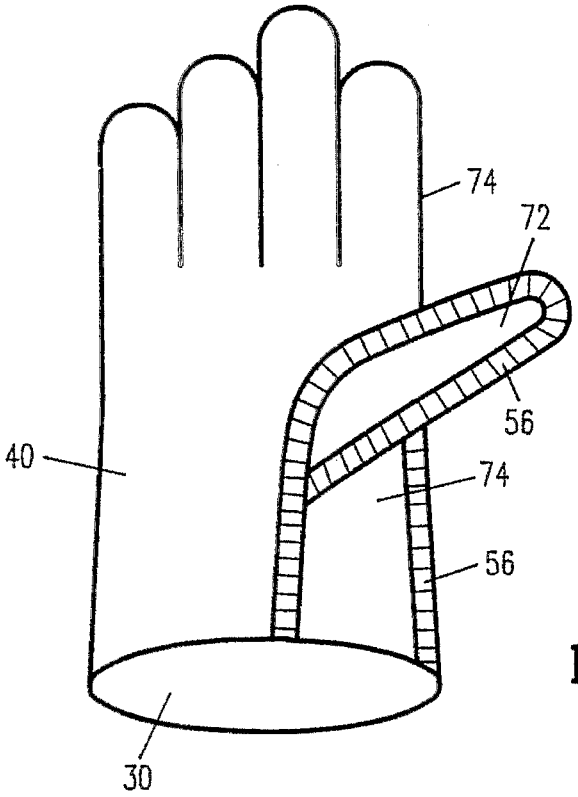

In an alternate embodiment, the palm portion 40 can have a cut-out 70 instead of a thumbhole 42, as illustrated in FIG. 6*a*. A two piece thumb portion comprising a tip portion 72 and a base portion 74, as illustrated in FIGS. 6*b–c*, is then used to fill in the cut-out 70 and provide for a thumb extension of the glove outside the plane of the finger portion. The tip portion 72 and the base portion 74 are sewn together. The composite thumb portion is also sewn to both the glove back 30 on one side and the palm portion 40 on the other, as illustrated in FIG. 6*d*. Sealing tape is used over stitches 56 for waterproofing.

The liner 10 is insertable inside an outer glove shell 6, as illustrated in FIG. 2*a*. The glove shell 6 protects the liner 10 from wear and tear as well as providing superior gripping action during use. An attachment means, not shown, comprising a snap, button etc. can be added to hold the liner 10 in place inside the shell 6. The attachment means would be especially useful while a user is removing the glove (liner 10 plus shell 6) from the hand.

The above described method is advantageous over the prior art for many reasons. First, by laminating the waterproof membrane to the cloth lining, the membrane is continuously supported by the cloth lining so as to resist wear and tear on the membrane. Second, by not using adhesives between the membrane and the cloth, the liner material breaths better. Third, the construction of the glove can still utilize two planer halves to construct the glove while providing for a thumb extension outside the plane of the finger extensions. Fourth, the amount of sewing required is reduced to just the area around the thumb. Sealing tape is very effective in this area because there is more room to insert the tape and the tape itself can be wider for a better seal.

It is to be understood that the present invention is not limited to the sole embodiment described above and illustrated herein, but encompasses any and all variations falling within the scope of the appended claims. For example, the present invention could apply to a mitten, whereby the four finger extensions are combined into a single finger pocket.

I claim:

1. A glove liner comprising:

a first hand-shaped piece of cloth laminated to a membrane material having substantially the same shape, said first hand piece being the shape of the back of a hand including a finger section;

a second hand-shaped piece of cloth laminated to a membrane material having substantially the same shape, said second hand piece being the shape of the front of a hand including a finger section and a palm section, said palm section having an opening for a thumb;

the outer edges of said first hand piece being welded to the outer edges of said second hand piece;

a thumb piece of cloth in the shape of a thumb laminated to a membrane material having substantially the same shape, said thumb piece sewn onto said palm section to fill in said opening; and tape attached to and covering said sewn seam between said second hand piece and said thumb piece.

2. A glove liner as in claim 1 whereby said welded edges of said first and second hand pieces are high frequency welded.

3. A glove liner as in claim 2 whereby at least one of said edges of said first and second hand pieces having silk-screened applied adhesive for high frequency welding.

4. A glove liner as in claim 3 whereby said second handpiece having a hole as said opening.

5. A glove liner as in claim 3 whereby said opening is formed by a recess in said edge of second handpiece and extending therefrom into said palm section; said thumbpiece sewn onto said palm section.

6. A glove liner as in claim 5 whereby said thumb piece comprising a tip thumb piece and a base thumb piece, the outer edges of said tip thumb piece being sewn to said outer edges of said base thumb piece.

7. A glove liner as in claim 6 whereby said first and second hand pieces extend away from said finger extensions for covering a wrist.

8. A glove liner as in claim 7 whereby said thumb piece sewed to said first hand piece.

9. A glove liner as in claim 3 whereby said cloth material faces the inside of said glove liner and said membrane material faces the outside of said glove liner.

10. A glove liner as in claim 3 whereby said glove liner is insertable inside a glove shell having substantially the same shape.

11. A glove liner as in claim 10 further comprising:

an attachment means that attaches said glove shell to said glove liner.

12. A glove liner as in claim 9 whereby said membrane material is semi-waterproof material such that said material passes water vapor but not liquid water.

13. A method of making a glove liner comprising the steps of:

laminating a cloth material to a membrane material to form a glove lining material;

cutting said glove lining material to form a first hand piece, a second hand piece, and a thumb piece, said first hand piece being in the shape of the back of a hand, said second hand piece being the shape of the front of a hand and having an opening for a thumb, and said thumb piece being the shape of a thumb;

applying adhesive to at least one of the edges of said first and second hand pieces;

welding said edges of said first hand piece to said edges of said second hand piece;

stitching said thumb piece to said second hand piece; and applying sealing tape over said stitching.

14. The method of making a glove liner as in claim 13 wherein said welding step comprises high frequency welding.

15. The method of making a glove liner as in claim 14 whereby said applying step utilizes a silkscreen method to apply said adhesive.

16. The method of making a glove liner as in claim 15 further comprising:

stitching said thumb piece to said first hand piece.

17. The method of making a glove liner as in claim 16 further comprising:

stitching said thumb piece together whereby said thumb piece comprises of a tip portion and a base portion.

18. The method of making a glove liner as in claim 15 whereby said first and second hand pieces are welded together such that said cloth material faces inside said glove liner and said membrane material facing outside said glove liner.

19. The method of making a glove liner as in claim 15 further comprising:

inserting said glove liner into an outer glove shell.

20. The method of making a glove liner as in claim 19 further comprising:

attaching said glove liner to said outer glove shell such that said glove liner stays inside said outer glove shell.

21. The method of making a glove liner as in claim 18 whereby said membrane material is semi-waterproof such that said membrane material passes water vapor but not liquid water.

* * * * *